US007494451B1

(12) United States Patent
Ramos

(10) Patent No.: US 7,494,451 B1
(45) Date of Patent: Feb. 24, 2009

(54) BARBELL COLLAR APPARATUS

(76) Inventor: Kervin R. Ramos, 1333 NW. 9th Ave., Ft. Lauderdale, FL (US) 33311

( * ) Notice: Subject to any disclaimer, the term of this patent is extended or adjusted under 35 U.S.C. 154(b) by 0 days.

(21) Appl. No.: 12/013,580

(22) Filed: Jan. 14, 2008

(51) Int. Cl.
*A63B 21/072* (2006.01)

(52) U.S. Cl. ..... 482/107; 482/93; 482/148

(58) Field of Classification Search ..... 482/14, 482/17, 38, 44–50, 98, 106–109, 148; 473/256, 473/437; 24/303, 499, 507, 521, 564; 403/261, 403/DIG. 1, DIG. 7, DIG. 9, DIG. 14; 269/8; 2/170; 601/15, DIG. 4; 602/2; 16/108, 109, 16/110.1, 112.1, 404, 421–446
See application file for complete search history.

(56) References Cited

U.S. PATENT DOCUMENTS

| | | | | | |
|---|---|---|---|---|---|
| 2,912,213 | A | * | 11/1959 | Krystosek | 248/499 |
| 3,124,501 | A | * | 3/1964 | Wise | 428/167 |
| 3,755,857 | A | * | 9/1973 | Simoneaux | 24/3.2 |
| 4,587,956 | A | * | 5/1986 | Griffin et al. | 600/15 |
| D287,387 | S | | 12/1986 | Oliver et al. | |
| 4,639,979 | A | | 2/1987 | Polson | |
| 4,888,875 | A | * | 12/1989 | Strother | 33/347 |
| 5,062,631 | A | | 11/1991 | Dau et al. | |
| 5,415,607 | A | | 5/1995 | Carpenter | |
| 5,628,716 | A | | 5/1997 | Brice | |
| 5,642,739 | A | * | 7/1997 | Fareed | 128/881 |
| 5,749,814 | A | * | 5/1998 | Chen | 482/93 |
| 5,901,379 | A | * | 5/1999 | Hirata | 2/170 |
| 6,048,303 | A | * | 4/2000 | Porter | 600/15 |
| 6,361,511 | B1 | * | 3/2002 | Shim | 601/137 |
| 6,679,816 | B1 | | 1/2004 | Krull | |
| 2001/0024999 | A1 | * | 9/2001 | Pappert | 482/105 |
| 2003/0017919 | A1 | * | 1/2003 | Lanoue | 482/107 |
| 2008/0200316 | A1 | * | 8/2008 | Shillington | 482/106 |

FOREIGN PATENT DOCUMENTS

| | | | |
|---|---|---|---|
| JP | 08332245 | A * | 12/1996 |

* cited by examiner

*Primary Examiner*—Loan H Thanh
*Assistant Examiner*—Victor K Hwang
(74) *Attorney, Agent, or Firm*—Crossley Patent Law; Mark A. Crossley

(57) ABSTRACT

A barbell collar apparatus features an elastomeric, flexible cylinder with a magnetic inner and an outer layer. Magnets are disposed adjacent to the inner layer, in various arrangement embodiments, to selectively secure the apparatus to a bar, typically disposed immediately adjacent to weights chosen, so that weights are retained against shifting and slippage along the bar. The apparatus is spread apart as needed for installation and removal from a bar. The apparatus is provided in pairs. The apparatus is provided in various colors to be easily identified and located. The light weight of the apparatus provides that additions to the weight and bar are negated in figuring the total weight lifted.

18 Claims, 4 Drawing Sheets

BARBELL COLLAR APPARATUS

CROSS-REFERENCE TO RELATED APPLICATIONS

Not Applicable

FEDERALLY SPONSORED RESEARCH OR DEVELOPMENT

Not Applicable

INCORPORATED BY REFERENCE OF MATERIAL SUBMITTED ON A COMPACT DISK

Not Applicable

BACKGROUND OF THE INVENTION

Weight training tools, such as barbells and dumbbells, typically comprise a bar onto which weights are added, via holes in the center of the weights. The bars are at least partially comprised of iron content. The ability for a user to add and subtract weights provides the selectable mass of resistance sought by the user. Various forms of temporarily retaining the weights on the bars have been employed. Metal collars with a threaded bolt perpendicularly employed to clamp the collar onto the bar are among the forms of temporary retention devices. These metal collars can scar the bar and are typically weighty. A user must, therefore, figure the weight of two such assemblies, then add this to achieve the total weight lifted. Another collar assembly includes a heavy hinged collar with wing nut for tightening the collar around the bar, once the collar is hingedly assembled in place. Such assemblies usually include a material on the internal diameter of the device which is provided to resist slippage.

These materials are often inadequate against slippage and require that the collars be severely tightened. These collars, too, are weighty. Still other collars do not fully open but provide for temporary increase in diameter in order for the collar to be slid onto the bar, the collars then tightened. All of the above types of collars are, to most users, so weighty and clumsy that their use is often ignored, which can allow weights to slide out of position, changing the bar's center of mass, or even fully slide off, and thereby endanger a user or anyone proximal to use. When not in use, at the very least these heavy collars provide a storage problem and foot hazard. Other collars include springs which, when gripped, expand an internal diameter. Release of grip allows the internal diameter to decrease, thereby clamping the spring onto the bar. Among these and various other devices which temporarily retain slideable weights on bars, convenience, proper function, and aesthetics are significant considerations. Time involved in applying and removing weight retention devices is of considerable concern to users. An additional consideration is that many users have difficulty using the above devices, often due to arthritis, carpal tunnel syndrome, and other maladies of wrists and hands. The present apparatus provides an aesthetically pleasing, easy to use lightweight weight retention apparatus which does not require that anything be tightened, gripped, slid onto an end of the bar, or otherwise significantly manipulated in order to function.

FIELD OF THE INVENTION

The barbell collar apparatus relates to exercise accessories and more especially to an apparatus to conveniently and selectively retaining weights on barbells and dumbbells.

SUMMARY OF THE INVENTION

The general purpose of the barbell collar apparatus, described subsequently in greater detail, is to provide a barbell collar apparatus which has many novel features that result in an improved barbell collar apparatus which is not anticipated, rendered obvious, suggested, or even implied by prior art, either alone or in combination thereof.

To attain this, the barbell collar apparatus is comprised of an elastomeric, flexible cylinder with an inner and outer layer. The inner layer is ideally magnetic, but may be provided in non-magnetic form. Magnets are disposed adjacent to the inner layer, in various arrangement embodiments, to selectively secure the apparatus to a bar, typically disposed immediately adjacent to weights chosen, so that weights are retained against shifting and slippage along the bar. The apparatus is spread apart as needed for installation and removal from a bar. The apparatus is provided in pairs. The apparatus is provided in various colors to be easily identified and located. The light weight of the apparatus provides that additions to the weight and bar are negated in figuring the weight lifted.

Thus has been broadly outlined the more important features of the improved barbell collar apparatus so that the detailed description thereof that follows may be better understood and in order that the present contribution to the art may be better appreciated.

An object of the barbell collar apparatus is to be lightweight.

Another object of the barbell collar apparatus is to be easily used.

A further object of the barbell collar apparatus is to prevent weight clutter in a workout area.

An added object of the barbell collar apparatus is to be aesthetically pleasing.

And, an object of the barbell collar apparatus is to be available in various colors, without added production expense.

Further, an object of the barbell collar apparatus is to be usable without the necessity of sliding the barbell collar onto the end of a bar.

These together with additional objects, features and advantages of the improved barbell collar apparatus will be readily apparent to those of ordinary skill in the art upon reading the following detailed description of presently preferred, but nonetheless illustrative, embodiments of the improved barbell collar apparatus when taken in conjunction with the accompanying drawings.

In this respect, before explaining the current embodiments of the improved barbell collar apparatus in detail, it is to be understood that the barbell collar apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved barbell collar apparatus. It is therefore important that the claims be regarded as including such equivalent constructions insofar as they do not depart from the spirit and scope of the barbell collar apparatus. It is also to be understood that the phraseology and terminology employed herein are for purposes of description and should not be regarded as limiting.

DETAILED DESCRIPTION OF THE DRAWINGS

Figure 1:
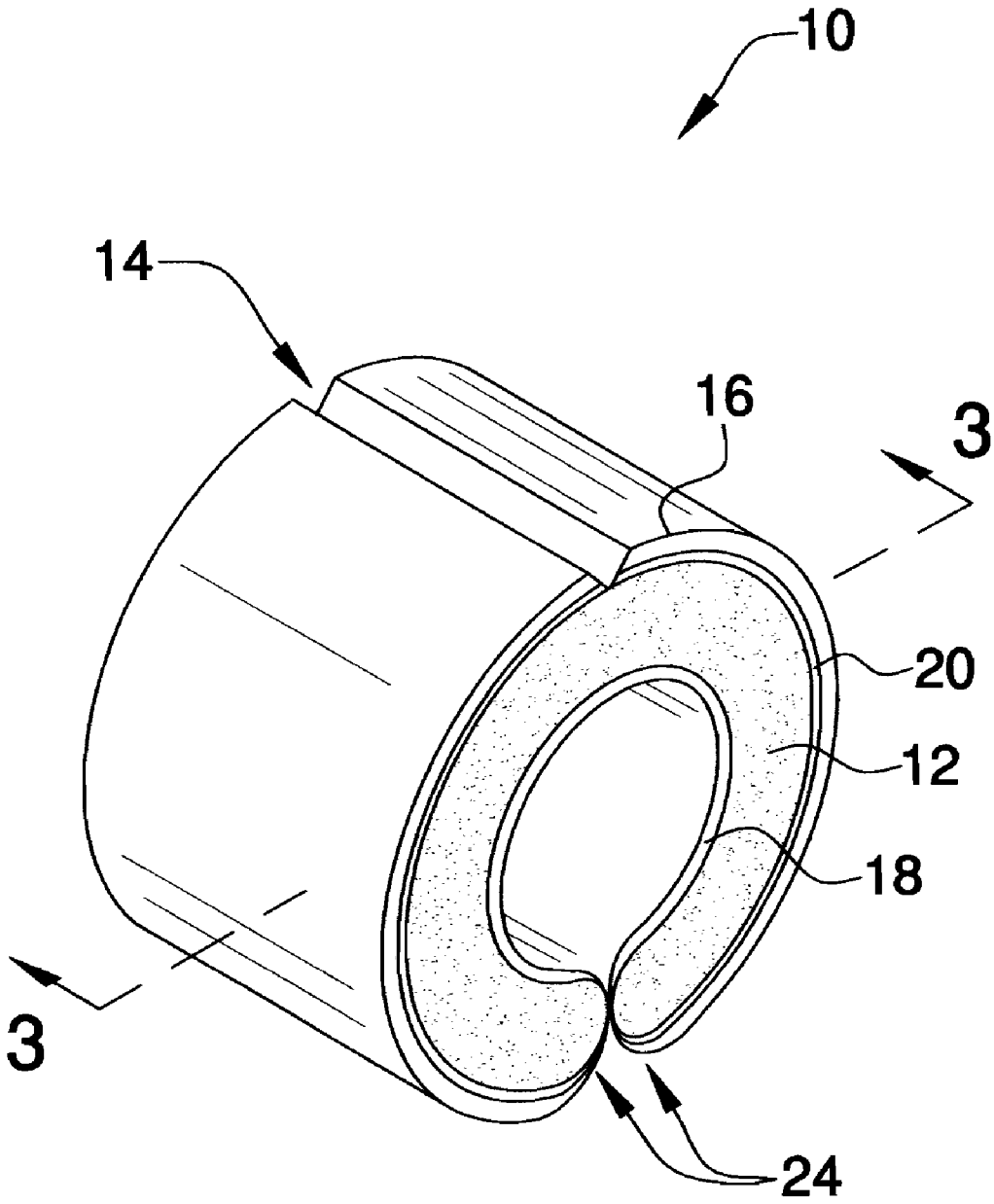
FIG. 1 is a perspective view.
Figure 2:
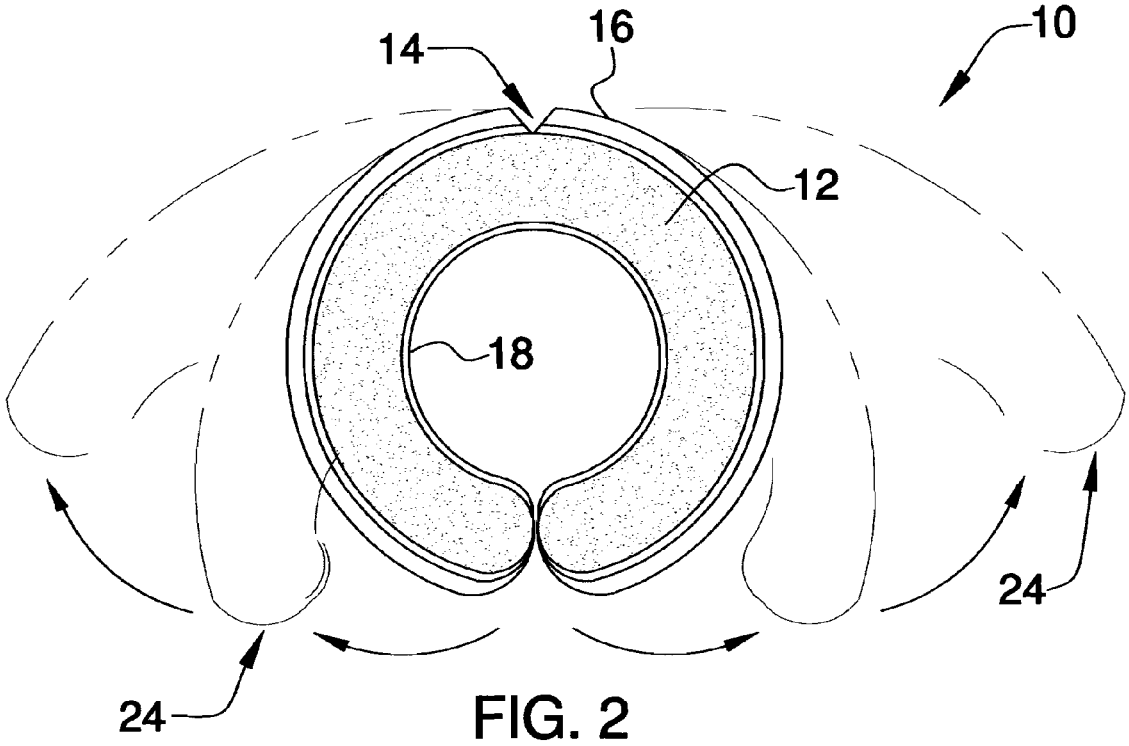
FIG. 2 is a an end elevation view.
Figure 3:
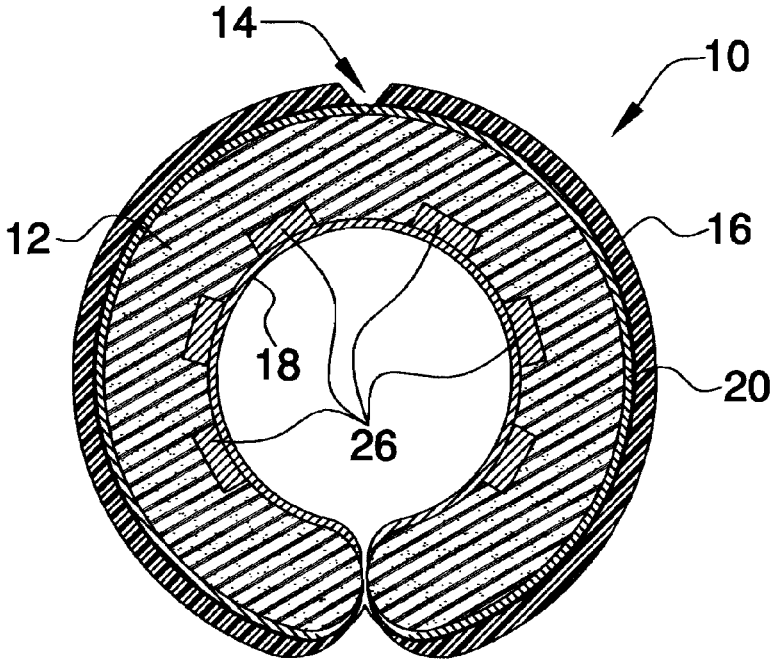
FIG. 3 is a cross sectional view of FIG. 1.
Figure 4:
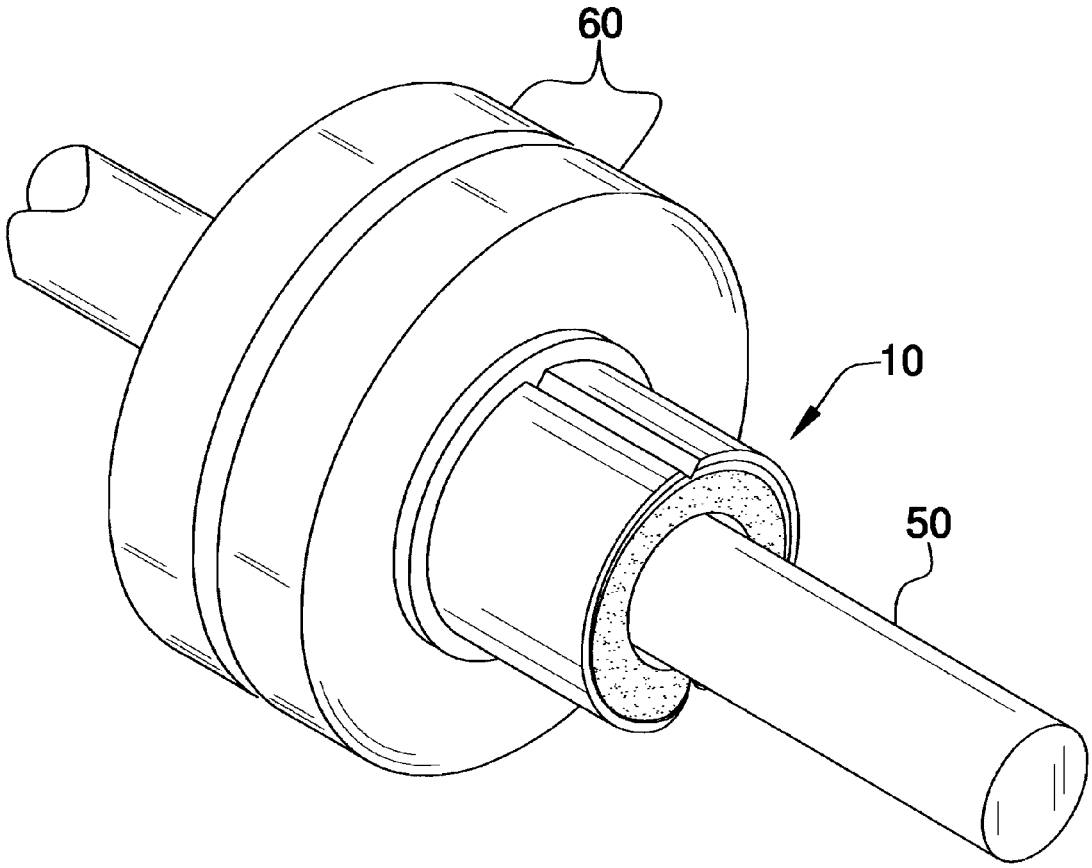
FIG. 4 is perspective view of the apparatus in use with bar and weights.

With reference now to the drawings, and in particular FIGS. 1 through 7 thereof, the principles and concepts of the barbell collar apparatus generally designated by the reference number 10 will be described.

Referring to FIGS. 1, 2, 3, 4, and 7, the barbell collar apparatus 10 is provided for selectively securing weights 60 on a bar 50, the bar 50 at least partially comprised of iron content. The apparatus 10 comprises an elastomeric cylinder 12 having a thickness, an inner diameter, an outer diameter, and a length. A full circle of the cylinder 12 is interrupted by a pair of opposed separate ends 24. The elastomeric magnetic inner layer 18 is affixed to the inner diameter of the cylinder 12. The inner layer 18 ends at each separate end 24. The outer layer 16 is bonded to the outer diameter of the cylinder 12 via the bonding layer 20. The outer layer 16 ends of each rounded end 24. The outer layer 16 is interrupted by the notch 14 disposed at the midpoint of the cylinder 12. The midpoint is opposite the separate ends 24. The notch 14 aids in flexibility of the apparatus 10, enabling less effort in spreading the cylinder 12 apart for installation and removal from a bar 50. This embodiment of the apparatus 10 features the plurality of longitudinally disposed spaced apart rows of magnets 26 embedded within the length of the cylinder 12. The magnets 26 are adjacent to the inner layer 18. The magnets 26 and the magnetic inner layer 18 secure the apparatus to the bar 50 as described. The cylinder 12 of the apparatus 10 is selectively spread apart at the separate ends 24 for removable fit of the apparatus 10 around the bar 50. The apparatus 10 is preferably placed immediately adjacent to the weights 60. The rounded ends 24 aid a user in grasping and separating the flexible cylinder 12. The rounded ends 24 further prevent injury that might otherwise be incurred in use if ends 24 were abrupt.

Figure 5:
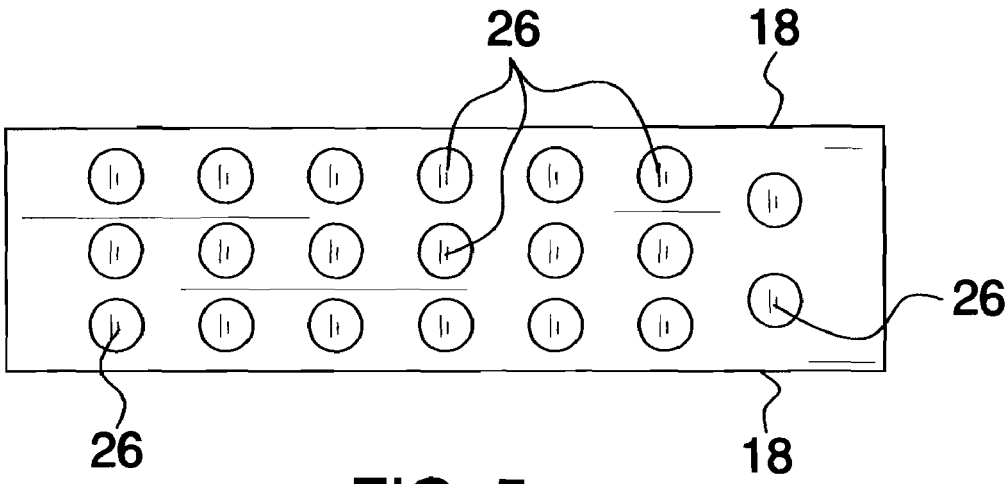
FIG. 5 is a lateral elevation view of one embodiment of the magnets and inner layer.

Referring to FIG. 5, the alternate embodiment of the magnets 26 and inner liner 18 relationship is illustrated. The magnets 26 are disposed in circumferentially arranged rows, each row spaced apart longitudinally from the next.

Referring to FIGS. 1, 2, 3, 4, and 7, the barbell collar apparatus 10 is provided for selectively securing weights 60 on a bar 50 at least partially comprised of iron content. The apparatus 10 comprises an elastomeric cylinder 12 having a thickness, an inner diameter, an outer diameter, and a length. The full circle of the cylinder 12 is interrupted by the pair of opposed separate ends 24. The ends 24 are rounded for the reasons explained above. The elastomeric magnetic inner layer 18 is affixed to the inner diameter of the cylinder 12. The inner layer 18 ends at each separate rounded end 24. The outer layer 16 is bonded to the outer diameter of the cylinder 12 via the bonding layer 20. The outer layer 16 ends at each rounded end 24. The outer layer is interrupted by the notch 14 at the midpoint of the cylinder 12. The midpoint is opposite the separates ends 24. The plurality of longitudinally disposed spaced apart rows of magnets 26 is embedded within the length of the cylinder 12. The magnets 26 are immediately adjacent to the inner layer 18. Each row of magnets 26 is arranged such that magnets 26 within each row are immediately adjacent to each other. The apparatus 10 is selectively spread apart at the separate ends 24 for removable fit of the apparatus 10 around the bar 50.

Figure 6:
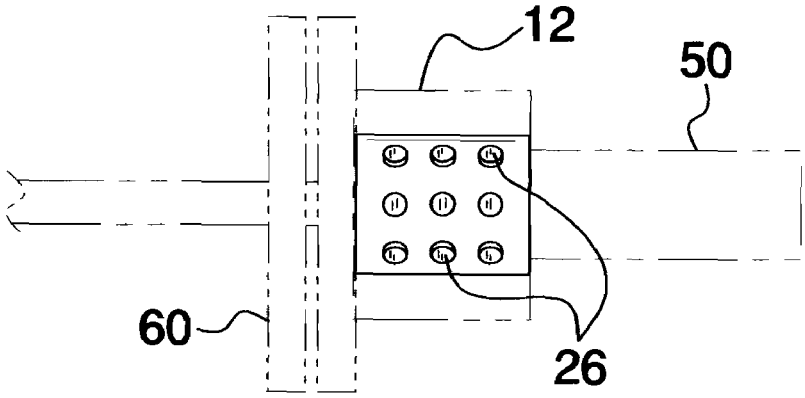
FIG. 6 is a lateral view of an alternate embodiment of the inner layer and magnets, in use with weights and bar.
Figure 7:
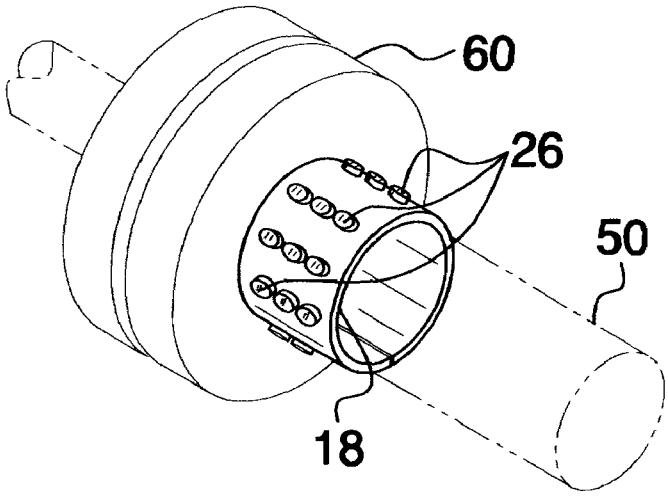
FIG. 7 is a perspective view of another embodiment of the inner layer and magnets, the apparatus in use with weights and bar.

Referring to FIGS. 5, 6, and 7, the varied embodiments of magnets 26 arrangement are conducive to use with varying iron contents of bars 50. Magnet 26 arrangement also varies with production costs, depending upon production equipment and steps taken.

With respect to the above description then, it is to be realized that the optimum dimensional relationships for the parts of the barbell collar apparatus, to include variations in size, materials, shape, form, function and the manner of operation, assembly and use, are deemed readily apparatus and obvious to one skilled in the art, and all equivalent relationships to those illustrated in the drawings and described in the specification are intended to be encompassed by the barbell collar apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the barbell collar apparatus may be used.

Therefore, the foregoing is considered as illustrative only of the principles of the barbell collar apparatus. Further, since numerous modifications and changes will readily occur to those skilled in the art, it is not desired to limit the barbell collar apparatus to the exact construction and operation shown and described, and accordingly, all suitable modifications and equivalents may be resorted to, falling within the scope of the barbell collar apparatus.

What is claimed is:

1. A barbell collar apparatus for selectively securing weights on a bar at least partially comprised of iron content, the apparatus comprising:

an elastomeric cylinder having a thickness, an inner diameter, an outer diameter, and a length, a full circle of the cylinder interrupted by a pair of opposed separate ends;

an elastomeric magnetic inner layer affixed to the inner diameter of the cylinder;

an outer layer bonded to the outer diameter of the cylinder, the outer layer interrupted by a notch at a midpoint of the cylinder, the midpoint opposite the separate ends;

whereby the apparatus is selectively spread apart at the separate ends for removable fit of the apparatus around the bar.

2. The apparatus according to claim 1 wherein the inner layer further comprises the inner layer ended at each separate end.

3. The apparatus according to claim 2 wherein the outer layer further comprises the outer layer ended at each separate end.

4. The apparatus according to claim 3 wherein each separate end is further rounded.

5. The apparatus according to claim 2 wherein each separate end is further rounded.

6. The apparatus according to claim 1 wherein the outer layer further comprises the outer layer ended at each separate end.

7. The apparatus according to claim 6 wherein each separate end is further rounded.

8. The apparatus according to claim 1 wherein each separate end is further rounded.

9. A barbell collar apparatus for selectively securing weights on a bar at least partially comprised of iron content, the apparatus comprising:

an elastomeric cylinder having a thickness, an inner diameter, an outer diameter, and a length, a full circle of the cylinder interrupted by a pair of separate ends;

an elastomeric magnetic inner layer affixed to the inner diameter of the cylinder, the inner layer ended at each separate end;

an outer layer bonded to the outer diameter of the cylinder, the outer layer interrupted by a notch at a midpoint of the cylinder, the midpoint opposite the separate ends;

a plurality of longitudinally disposed spaced apart rows of magnets embedded within the length of the cylinder, the magnets adjacent to the inner layer;

whereby the apparatus is selectively spread apart at the separate ends for removable fit of the apparatus around the bar.

10. The apparatus according to claim 9 wherein the inner layer further comprises the inner layer ended at each separate end.

11. The apparatus according to claim 10 wherein the outer layer further comprises the outer layer ended at each separate end.

12. The apparatus according to claim 11 wherein each separate end is further rounded.

13. The apparatus according to claim 10 wherein each separate end to further rounded.

14. The apparatus according to claim 9 wherein the outer layer further comprises the outer layer ended at each separate end.

15. The apparatus according to claim 14 wherein each separate end is further rounded.

16. The apparatus according to claim 9 wherein each separate end is further rounded.

17. A barbell collar apparatus for selectively securing weights on a bar at least partially comprised or iron content, the apparatus comprising:

an elastomeric cylinder having a thickness, an inner diameter, an outer diameter, and a length, a full circle of the cylinder interrupted by a pair of opposed separate ends;

an elastomeric magnetic inner layer affixed to the inner diameter of the cylinder, the inner layer ended at each separate end;

an outer layer bonded to the outer diameter of the cylinder, the outer layer interrupted by a notch at a midpoint of the cylinder, the midpoint opposite the separate ends;

a plurality of longitudinally disposed spaced apart rows of adjacently disposed magnets embedded within the length of the cylinder, the magnets adjacent to the inner layer;

whereby the apparatus is selectively spread apart at the separate ends for removable fit of the apparatus around the bar.

18. The apparatus according to claim 17 wherein each separate end is further rounded.

* * * * *